US012313301B2

(12) United States Patent
Melia

(10) Patent No.: US 12,313,301 B2
(45) Date of Patent: May 27, 2025

(54) LOW-EMISSIONS HEATING, COOLING AND HOT WATER SYSTEM

(71) Applicant: HARVEST THERMAL, INC., Kensington, CA (US)

(72) Inventor: Elisabeth Jane Melia, Kensington, CA (US)

(73) Assignee: HARVEST THERMAL, INC., Kensington, CA (US)

( * ) Notice: Subject to any disclaimer, the term of this patent is extended or adjusted under 35 U.S.C. 154(b) by 0 days.

(21) Appl. No.: 18/332,329

(22) Filed: Jun. 9, 2023

(65) Prior Publication Data

US 2023/0314043 A1 Oct. 5, 2023

Related U.S. Application Data

(62) Division of application No. 16/544,402, filed on Aug. 19, 2019, now Pat. No. 12,013,152.

(51) Int. Cl.
*F24H 9/20* (2022.01)
*F24D 17/00* (2022.01)
(Continued)

(52) U.S. Cl.
CPC ..... *F24H 9/2014* (2013.01); *F24D 17/0089* (2013.01); *F24D 17/02* (2013.01); *F24D 19/1006* (2013.01); *F24H 15/375* (2022.01)

(58) Field of Classification Search
None
See application file for complete search history.

(56) References Cited

U.S. PATENT DOCUMENTS 3,996,759 A * 12/1976 Meckler ..... F25B 29/003 165/104.31
4,739,624 A * 4/1988 Meckler ..... F24F 3/001 62/238.7

(Continued)

FOREIGN PATENT DOCUMENTS

EP 1113231 B1 7/2001

OTHER PUBLICATIONS

Production efficiency of hot water for domestic use, P.J. Boait, D. Dixon, D. Fan, A. Stafford, Nov. 7, 2012 vol. 54 pp. 160-168, United Kingdom.

*Primary Examiner* — Thor S Campbell
(74) *Attorney, Agent, or Firm* — Evergreen Valley Law Group; Kanika Radhakrishnan

(57) ABSTRACT

A hydronic system, of the present disclosure, includes a control unit including a memory comprising stored instructions and a processor configured to execute the stored instructions to cause the control unit to perform at least monitoring, a volume of hot water in a hot storage tank via a first set of flowmeters, monitoring, a volume of chilled water in a cold storage tank via a second set of flowmeters, monitoring, a first outlet temperature of the hot water within the hot storage tank via a first temperature sensor and a second outlet temperature of the chilled water within the cold storage tank via a second temperature sensor, and operating, a heat pump unit for recharging the hot water and the chilled water within the hot storage tank and the cold storage tank respectively. The heat pump unit is operated when a respective predetermined limit reaches for anyone of identified parameters.

10 Claims, 8 Drawing Sheets

(51) Int. Cl.

| | |
|---|---|
| ***F24D 17/02*** | (2006.01) |
| ***F24D 19/10*** | (2006.01) |
| ***F24H 15/375*** | (2022.01) |

(56) References Cited

U.S. PATENT DOCUMENTS

| | | | | |
|---|---|---|---|---|
| 5,497,629 | A * | 3/1996 | Rafalovich | F25B 29/003 62/332 |
| 7,284,710 | B2 | 10/2007 | Rixen et al. | |
| 7,356,997 | B2 * | 4/2008 | Gruber | A01J 9/04 62/157 |
| 9,016,079 | B2 * | 4/2015 | Pedersen | F24H 15/262 62/238.7 |
| 9,175,865 | B2 * | 11/2015 | Kristjansson | F24D 11/0221 |
| 9,810,438 | B2 | 11/2017 | Rothman et al. | |
| 10,072,856 | B1 * | 9/2018 | Akin | F24D 12/02 |
| 2010/0038441 | A1 * | 2/2010 | Pedersen | F25B 30/06 237/2 B |
| 2012/0152232 | A1 * | 6/2012 | Pedersen | F24D 18/00 165/10 |
| 2012/0180511 | A1 * | 7/2012 | Pedersen | F24H 4/04 62/238.7 |
| 2013/0200168 | A1 * | 8/2013 | Buescher | F24H 15/238 29/428 |
| 2016/0305671 | A1 * | 10/2016 | Madigan | F24D 19/1063 |
| 2019/0089550 | A1 * | 3/2019 | Rexach | G10L 15/1822 |
| 2019/0277523 | A1 * | 9/2019 | Wallace | F24F 11/62 |
| 2019/0294193 | A1 * | 9/2019 | Steffes | H02J 13/00009 |
| 2020/0378651 | A1 * | 12/2020 | Diemer Lopes | F24D 19/088 |
| 2023/0280770 | A1 * | 9/2023 | Krebs | E03C 1/0404 4/668 |

* cited by examiner

LOW-EMISSIONS HEATING, COOLING AND HOT WATER SYSTEM

TECHNICAL FIELD

The present disclosure relates to systems and methods for operating a hydronic heating, cooling and domestic hot water system.

BACKGROUND

Hydronic systems are typically thermo-fluid dynamic systems, which are configured for home, commercial, and/or industrial use. The hydronic systems employ water as a heat transfer fluid for heating or cooling the interiors of homes, commercial buildings, or industrial facilities. More often, the hydronic systems are used for supply of domestic hot water for use in washbasins, showers and baths.

Conventional hydronic systems use fossil energy sources, such as gas, propane, fuel oil and the like, or electricity for operation. Electric hydronic systems utilize the energy generated by power plants, many of them powered by the combustion of fossil fuels, which generates greenhouse gases (GHG) and other air pollution including particulates, ozone, nitrogen dioxide, sulphur dioxide, etc. Emissions from grid-supplied electricity vary by time of day and day of year and can range from zero when the marginal generator is renewable, hydro, or nuclear, to very high when the marginal generator is a peak power plant at times of peak grid demand.

Further, as time-varying electricity rates become increasingly common, the cost incurred for operating electric hydronic systems also varies by time of operation. Thus, for an efficient, low-emissions, and cost-effective operation of an electric hydronic system, the user may be required to keep a track of the cost and emissions of the energy source, which is mundane, cumbersome, and a time-consuming process. Moreover, energy losses such as diffusion loss and standby loss, may occur which is uneconomical.

To reduce the use of hydronic systems employing fossil fuels, while minimizing operating costs and emissions, attempts have been made to employ electrical systems with thermal storage. However, the electrical systems with thermal storage have been uneconomical and impractical to use in residential applications, due to high installation costs, efficiency losses in thermal storage, and complexity in piping design and controls that operate the heat pump.

Therefore, there is a need for techniques which can overcome one or more limitations stated above in addition to providing other technical advantages.

SUMMARY

Various embodiments of the present disclosure provide methods and systems for operating a hydronic system.

The present disclosure provides a method for operating the hydronic system, which includes monitoring, by a control unit, a volume of hot water in a hot storage tank using a first flowmeter and a volume of chilled water in a cold storage tank using a second flowmeter. A first outlet temperature of the hot water exiting the hot storage tank is monitored by the control unit, via a first temperature sensor and a second outlet temperature of the chilled water exiting the cold storage tank is monitored by the control unit via a second temperature sensor. The volume of hot water and the temperature of the hot water are used to calculate a state of charge of the hot water tank. The volume of chilled water and the temperature of the chilled water are used to calculate the state of charge of the cold water tank. The SoC is the volume of water that could be delivered from the tank at a certain predefined temperature. This could for example be the amount or volume of water that could be delivered from the tank at 120 degrees Fahrenheit. A heat pump unit is operated by the control unit, for recharging the hot water and the chilled water within the hot storage tank and the cold storage tank respectively. The heat pump unit is operated when a respective predetermined limit reaches for at least one of the state of charge of hot water, the state of charge of chilled water, the first outlet temperature and the second outlet temperature.

The present disclosure also provides the hydronic system including the control unit. The control unit includes a memory including stored instructions and a processor configured to execute the stored instructions to cause the control unit to perform at least monitoring, the volume of hot water in the hot storage tank via the first set of one or more flowmeter and the volume of chilled water in the cold storage tank via the second set of flowmeter. The first outlet temperature of the hot water exiting or within the hot storage tank is monitored, via the first temperature sensor and the second outlet temperature of the chilled water exiting or within the cold storage tank via the second temperature sensor. The heat pump unit is operated by the control unit, for recharging the hot water and the chilled water within the hot storage tank and the cold storage tank respectively. The heat pump unit is operated when the respective predetermined limit reaches for at least one of the state of charge of hot water, the state of charge of chilled water, the first outlet temperature and the second outlet temperature. The heat pump is also operated to recharge the system ahead of usage, taking into account the value of energy used to charge and predicted usage. Value of the energy used can mean price, emissions or any other parameter.

BRIEF DESCRIPTION OF THE FIGURES

The following detailed description of illustrative embodiments is better understood when read in conjunction with the appended drawings. For the purpose of illustrating the present disclosure, exemplary constructions of the disclosure are shown in the drawings. However, the present disclosure is not limited to a specific device or a tool and instrumentalities disclosed herein. Moreover, those in the art will understand that the drawings are not to scale. Wherever possible, like elements have been indicated by identical numbers.

Figure 1:
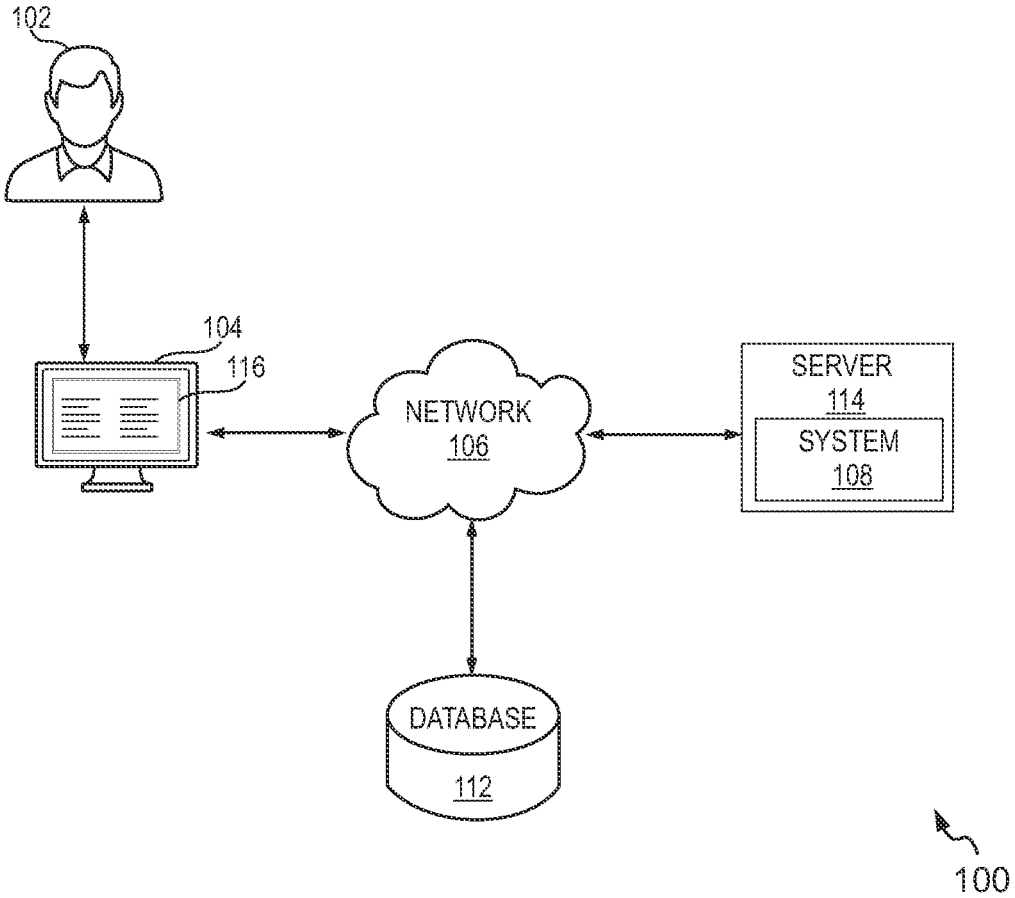
FIG. 1 is an example representation of an environment related to at least some example embodiments of the present disclosure.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearance of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

OVERVIEW

Various embodiments of the present disclosure provide a method for operating a hydronic system configured to condition an enclosure as per requirement, while also supplying hot water for domestic use. The method includes monitoring by a control unit a volume of a hot water in a hot storage tank via a first set of flowmeters. The hot water is routed to an enclosure for at least conditioning the enclosure and for the domestic water use. The control unit is also configured to monitor volume of chilled water in a cold storage tank via a second set of flowmeters. The chilled water is routed to the enclosure for at least conditioning the enclosure. Further, the control unit is configured to monitor a first outlet temperature of the hot water exiting or within the hot water tank via a first set of temperature sensors and a second outlet temperature of the cold water exiting or within the tank via a second set of temperature sensors. As such, based on the aforementioned parameters monitored by the control unit, a state of charge (SoC) or condition of the hot water and the cold-water present in the hot storage tank and the cold storage tank respectively, is determined. When the SoC of the hot water and the cold water reaches a predetermined limit, the control unit can in certain embodiments be configured to operate a heat pump for recharging the hot water and the cold water respectively. Further, the control unit may also consider a temperature of the hot water exiting or within the hot water tank and the temperature of the cold water exiting or within the cold water tank to the enclosure, for monitoring the predetermined limit. As such, when the temperature of the hot water exiting or within the hot water tank reduces to a threshold value and the temperature of the cold water exiting or within the cold water tank increases to a threshold value, the control unit can in certain embodiments be configured to operates the heat pump suitably for recharging the hot water and the cold water. The control unit further determines a time period required for recharging the hot water and the cold water via the heat pump, based on their SoC and an operation cycle. The operation cycle may be at least an on-peak operation cycle and an off-peak operation cycle. During the on-peak operation cycle, the heat pump instantaneously operates the heat pump for recharging the hot water within the time period, until the operating temperatures of the hot water and the cold water are restored. Further, during the off-peak operation cycle, the heat pump is selectively operated based on a cost, emissions, a schedule of operation of a power source and the like, until the operating temperatures of the hot water and the cold water are restored. This configuration ensures that the heat pump can be efficiently operated, thereby optimizing the use of the power source. Consequently, reducing the emissions and the costs associated with operation of the system.

The present disclosure also provides a hydronic system. The hydronic system includes processing capabilities for implementing the aforesaid method.

Although process steps, method steps or the like in the disclosure may be described in sequential order, such processes and methods may be configured to work in alternate orders. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention (s), and does not imply that the illustrated process is preferred.

Various embodiments with respect to methods and systems for controlling operation of a hydronic system are described in FIG. 1 to FIG. 7.

Figure 2A:
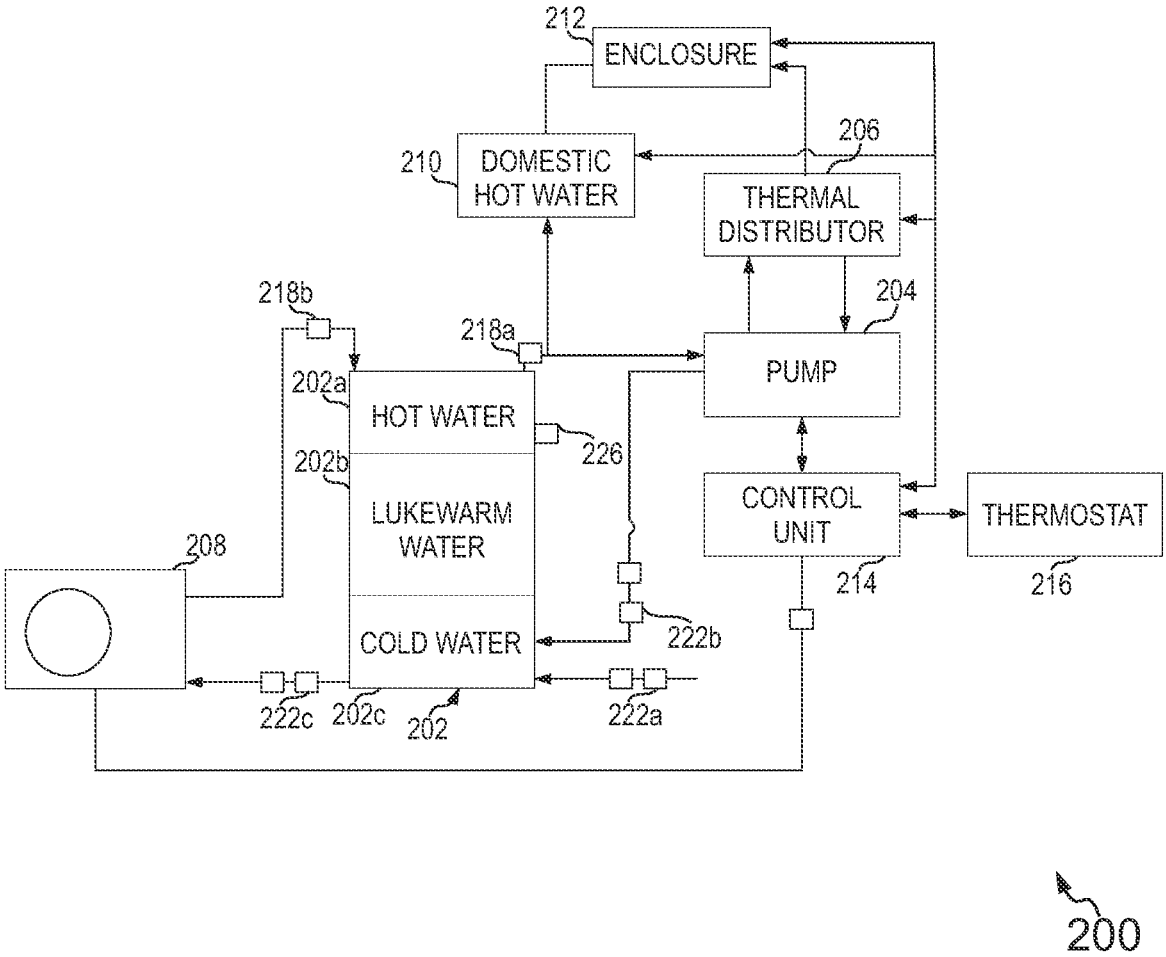
FIG. 2A is a schematic representation of a hydronic system, in accordance with an example embodiment of the present disclosure.

FIG. 1 is an example representation of an environment 100 related to at least some example embodiments of the present disclosure. The environment 100 includes a user 102 (collectively referred for plurality of users) interacting with a system 108 configured for operating a hydronic system 200 (for e.g. as shown in FIG. 2A). The user 102 may be an individual or an entity, who is in need of a hot water supply or a chilled water supply from the hydronic system 200 or who is need of conditioning an enclosure 212 (for e.g. as shown in FIG. 2A). The user 102 is associated with a device 104, for providing an input information required for operating the system 108 via a network 106. The input information from the user 102 may include such as, but not limited to, a requirement of hot water, a variation in a temperature of the hot water supply or the chilled water supply, a variation in the temperature of conditioning the enclosure or any other information required for operation of the system 108. The user 102 may provide the input information to the system 108 using an interactive analytic application 116 (hereinafter referred to as 'application 116') made available at the device 104. The device 104 may include devices, such as laptops, tablets, desktops, smartphones, wearable devices, workstation terminals or other computing devices with network interfaces, such as micro-PCs, smart watches, etc. The network 106 may also be a centralized network or a decentralized network or may include a plurality of sub-networks that may establish a direct communication between the user 102 and the system 108 or may offer indirect communication between the user 102 and the system 108. Typical examples of the network 106 include, but are not limited to, a wireless or wired Ethernet-based intranet, a local or wide-area network (LAN or WAN), and/or global communications network known as the Internet, which may accommodate many different communications media and protocols.

The environment 100 also includes a server 114 configured for operating the hydronic system 200, which is described in subsequent paragraphs of the description. The system 108 may be embodied within the server 114 or may be a standalone component associated with the server 114. The system 108 is configured to host and manage the application 116, which is accessible to the device 104. The application 116 may be accessible through a website associated with the server 114, so that the user 102 may access the website over the network 106 using Web browser applications installed in the device 104 and, thereafter perceive to operate the hydronic system 200. In an embodiment, the server 114 is configured to facilitate instances of the application 116 to the device 104, upon receiving a request for accessing the application 116. The server 114 upon receiving the request allows instances of the application 116 to be downloaded into the device 104 for accessing the application 116. In an embodiment, the application 116 may include the Application Programming Interface (API) and other components, which may rest on the server 114. In this scenario, the application 116 can be made available at application stores, such as Google play store managed by Google®, Apple app store managed by Apple®, etc., and are downloadable from the application stores to be accessed on devices such as the device 104. In some alternate embodiments, the application 116 may be pre-installed on the device 104 as per the factory settings. In one configuration, the application 116 is also configured to generate and dynamically update a dashboard (not shown in Figures) by including the input information provided by the user 102. In another configuration, the application 116 is also configured to generate and dynamically update the dashboard by including estimated costs associated with operation of the hydronic system 200 based on the input information provided.

In an embodiment, the input information may be provided by the user 102 frequently via the application 116, and the estimated costs for operating the hydronic system 200 may be fetched through another endpoint in the application 116 (not shown in Figures).

The environment 100 further includes a database 112 configured to store information pertaining to the input information provided by the user 102. The input information may be the information provided by the user 102 pertaining to the conditioning of the enclosure and the temperature requirements of the hot water and the cold water, to the hydronic system 200. The database 112 may also be configured to store data pertaining to the determined temperatures, capacities of the storage tanks and the like. The database 112 may be maintained by a third party or embodied within the server 114.

In an example, the server 114 is configured to monitor a volume of the hot water and the cold water in a hot storage tank and a cold storage tank respectively. The server 114 is also configured to monitor the first outlet temperature of the hot water and the second outlet temperature of the cold water. The server 114 may operate a heat pump unit for recharging the hot water and the chilled water suitably, when a respective predetermined limit is reached for at least one of the state of charge of the hot water, the state of charge of the chilled water, the first outlet temperature and the second outlet temperature. In one configuration, the server 114 may use the parameters, the volume of the hot water and the first outlet temperature to determine a State of Charge (SoC) of the hot water. In another configuration, the server 114 may use the parameters the volume of the chilled water and the second outlet temperature to determine a State of Charge (SoC) of the chilled water. As such, the server 114 may be configured to operate the heat pump unit based on the SoC of the hot water and the chilled water.

Additionally, the server 114 is configured to determine a time period required for recharging the volume of the hot water. Thus, the server 114 operates the heat pump unit based on the time period determined. The time period may be determined by the server 114 based on the SoC of the hot water and an operation cycle which may be an on-peak operation cycle and an off-peak operation cycle. During the on-peak operation cycle, the server 114 may operate the heat pump unit instantaneously for recharging the hot water within the time period, which is explained in detail in subsequent sections. During the off-peak operation cycle, the heat pump unit is selectively operated based on a cost and schedule of a power source for recharging the hot water. The cost, emissions and schedule of the power source may be stored in the database 112 directly, or as a look up table (not shown in Figures). In one implementation, the cost of the power source may represent the price of the power source, the emissions due to that power source or any other parameter. In one configuration, the heat pump unit is operated when at least one of the SoC of the hot water and the first outlet temperature have reached the predetermined limit.

Further, the server 114 is configured to determine a time period required for recharging the volume of the chilled water. Thus, the server 114 operates the heat pump unit based on the time period determined. The time period may be determined by the server 114 based on the SoC of the chilled water and the operating cycle. During the on-peak operation cycle, the server 114 operates the heat pump unit instantaneously for recharging the chilled water within the time period, which is explained in detail in subsequent section. During the off-peak operation cycle, the heat pump unit is selectively operated based on the cost, emissions and schedule, or other parameter, for the power source for recharging the chilled water. In one configuration, the heat pump unit is operated when at least one of the SoC of the chilled water and the second outlet temperature have reached the predetermined limit. This configuration ensures that the heat pump unit is operated selectively, thereby reducing the cost of operation, emissions generated during use of the power or other relevant parameter, while also optimizing the performance of operation of the hydronic system 200.

Figure 2B:
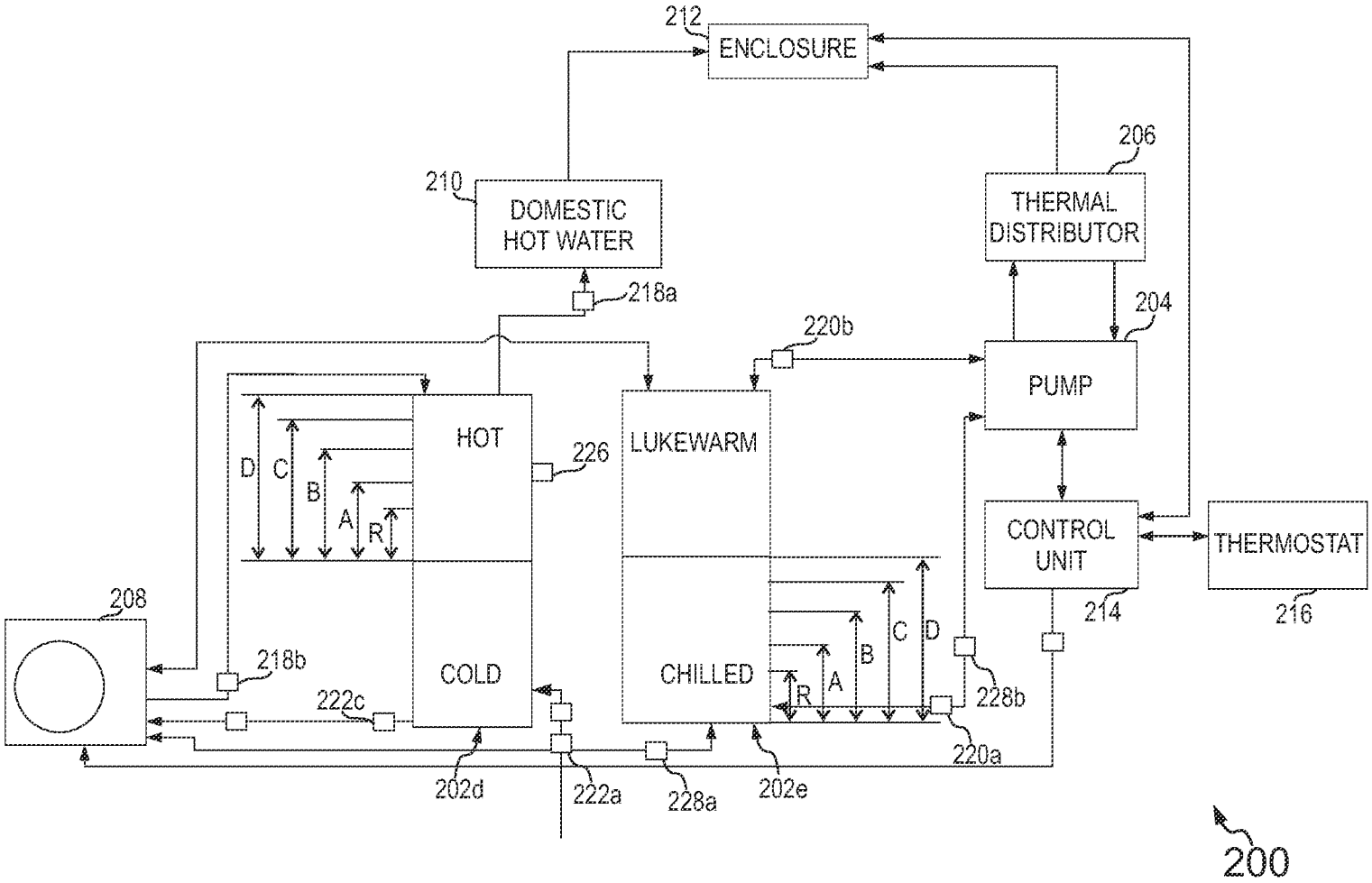
FIG. 2B is a schematic representation of a hydronic system, in accordance with another example embodiment of the present disclosure.

FIGS. 2A and 2B is a schematic representation of the hydronic system 200, in accordance with some example embodiments of the present disclosure. The system 200 includes a thermal storage tank 202 configured to store water therein. The thermal storage tank 202 may be divided into a compartment 202*a* (i.e. a top portion) for storing the hot water, a compartment 202*b* for storing a lukewarm water and a compartment 202*c* (i.e. a bottom portion) for storing the chilled water. The thermal storage tank 202 may be configured with a thermal shielding surface for maintaining the temperature of the water therein. In one configuration, in the portion 202*c*, a cold water may also be stored, as per design feasibility and requirement. The portions 202*a*-202*c* may be formed due to a thermocline layer (referenced as a line within the tank 202) formed due to the temperature difference between the hot water, the lukewarm water and the chilled water. In one implementation, the hot water may be the water heated to a temperature from about 130° F. to about 170° F. or any other temperature as per feasibility and requirement. In another implementation, the lukewarm water may be the water available in the room temperature, with the temperature range of about 25° C. to about 30° C. or any other temperature as per requirement. In yet another implementation, the chilled water may be the water cooled to the temperature 10° C. or any other temperature as per requirement. In another implementation, the cold water may be the water cooled to the temperature range of about 11° C. to about 20° C. or any other temperature as per requirement.

The thermal storage tank 202 is fluidically coupled to a pump 204. The pump 204 is further fluidically coupled via conduits, to a thermal distributor 206, a heat pump unit 208, a domestic hot water tank 210 and the enclosure 212. As such, the pump 204 is configured to circulate or route the hot water, the chilled water and the lukewarm water suitably within the system 200. In one configuration the pump 204 may be a unit selected from group comprising a positive displacement pump, a peristaltic pump, a centrifugal pump or any other pump as per design feasibility and requirement.

In one configuration, the thermal storage tank 202 may be divided into a hot storage tank 202*d* and a cold storage tank 202*e* (for e.g. as shown in FIG. 2B). The hot storage tank 202*d* may be configured to store the hot water (for e.g., at a top portion 202*a* as shown in FIG. 2A) and the cold water (for e.g. at a bottom portion 202*c* as shown in FIG. 2A). The thermocline layer will separate the hot water and the cold water. The cold storage tank 202*e* may be configured to store the lukewarm water and the chilled water. The thermocline layer will separate the lukewarm water and the cold water. The hot storage tank 202*d* and the cold storage tank 202*e* may be fluidically coupled to the pump 204 for enabling circulation of the hot water and the chilled water suitably.

Further, the system 200 may be configured with a first set of flowmeters 222*a*, 222*b* and 222*c* mounted at the inlet and exit of the hot water tank. The first set of flowmeters 222*a*, 222*b* and 222*c* are configured to monitor the volume of the water entering and exiting the hot storage tank 202*d* over time and allow the control unit 214 to determine the volume of hot water in the tank. The first flowmeters 222*a*, 222*b* and 222*c* may be one of an optical sensor, a mechanical sensor or any other sensor configured for monitoring the water flow within the conduits entering and exiting the hot storage tank 202*d*. The system 200 may also include a first set of temperature sensors 218*a* and 218*b* (hereinafter referred to as temperature sensors 218) mounted to the conduit exiting and entering the portion of the tank containing the hot water. The first set of temperature sensor 218 is configured to monitor the temperature of the water exiting or entering the hot storage tank 202*d*. In one configuration, the flowmeters 222*a*, 222*b* and 222*c* and the temperature sensors 218 may also be suitably incorporated in the thermal storage tank 202 (not shown in Figures).

The cold storage tank 202*e* may be configured with a second set of flowmeters 228*a* and 228*b* mounted at the inlet and exit of the portion containing the chilled water. The second set of flowmeters 228*a* and 228*b* are configured to monitor the volume of the chilled water entering and exiting the cold storage tank 202*e* over time and allow the control unit 214 to determine the volume of hot chilled water in the tank. The second flowmeters 228*a* and 228*b* may one of an optical sensor, a mechanical sensor or any other sensor configured for monitoring the chilled water flow within the conduits entering and exiting the cold storage tank 202*e*. The system 200 also includes a second set of temperature sensors 220*a* and 220*b* (for e.g. as shown in FIG. 2B) mounted to conduit exiting or entering the portion of the tank containing the chilled water and exiting or entering the portion of the tank containing the lukewarm water. The second set of temperature sensors 220*a* and 220*b* (hereinafter referred to as temperature sensors 220) is configured to monitor the temperature of the water exiting or entering the cold storage tank 202*e*. In one configuration, the flowmeters 228*a* and 228*b* (for e.g. as shown in FIG. 2B) and the temperature sensors 220*a* and 220*b* may be suitably incorporated in the thermal storage tank 202.

Further, the system 200 includes a first temperature sensor 226 mounted to the tank 202*d*. The first temperature sensor 226 is configured to monitor the temperature of the hot water within the tank 202*d*. This configuration for example can be used to calibrate the SoC calculation. In one configuration the conduit extending from the hot storage tank 202*d* for supplying the hot water, may be directly connected to the enclosure 212 (not shown in Figures). In one configuration the conduit extending from the cold storage tank 202*e* for supplying the chilled water to the thermal distributor 206 may be directly connected instead to a domestic supply tank 210 (not shown in Figures). The thermal distributor 206 on receiving either of the hot water or the chilled water via the pump 204 distributes the heat content to the enclosure 212 for conditioning. The thermal distributor 206 may be a blower (not shown in the Figures) configured for distributing the heat content into the enclosure 212.

The system 200 also includes the heat pump unit 208 configured for generating either the hot water or the chilled water. The hot water and the cold water generated in the heat pump unit 208 is routed back to the thermal storage tank 202 or the hot storage tank 202*d* and the cold storage tank 202*e* respectively. In one configuration, the heat pump unit 208 receives cold water from (i.e. the bottom portion) the hot storage tank 202*d* which would be heated for generating the hot water. The generated hot water is routed to the hot storage tank 202*d* (i.e. the top portion), for recharging the hot water. In another configuration, the heat pump unit 208 receives lukewarm water from (i.e. the top portion) the cold storage tank 202*e*, which would be cooled to generate the chilled water. The chilled water is circulated back to the cold storage tank 202*e* (i.e. to the bottom portion).

In one implementation, recharging of the hot water and/or the cold water may refer to increasing the volume of the hot water and/or the cold water for use in the system 200. In another implementation, recharging of the hot water and/or the cold water may refer to raising the heat content in the hot water and/or the cold water for use in the system 200. In other words, the heat pump unit 208 may heat the hot water to increase its temperature or may cool the chilled water to reduce its temperature, thereby increasing its heat content. Thus, the term recycling may be considered to apply, based on the necessity or requirement of the system 200.

The system 200 also includes a control unit 214 communicably coupled with the thermal storage tank 202, the hot storage tank 202*d*, the cold storage tank 202*e*, the pump 204, the thermal distributor 206, the domestic hot water 210, the heat pump unit 208 and the enclosure 212. The control unit 214 is configured to control operations of the components in the system 200 for ensuring optimal operational efficiency, while incurring minimal operation costs, emissions or any other parameter, which would be further explained with reference to FIG. 4. The control unit 214 is also configured to receive the input information from the user 102, based on which the control unit 214 may operate the system 200. The input information provided by the user 102, which relates to the temperatures are received through a thermostat 216. The thermostat 216 may record the required thermal value or temperature value in the system 200 suitably, and provide such data to the control unit 214. In one implementation, the control unit 214 may automatically determine the requirements of the enclosure 212 and accordingly, operate the system 200 for conditioning the enclosure 212 suitably.

Figure 3:
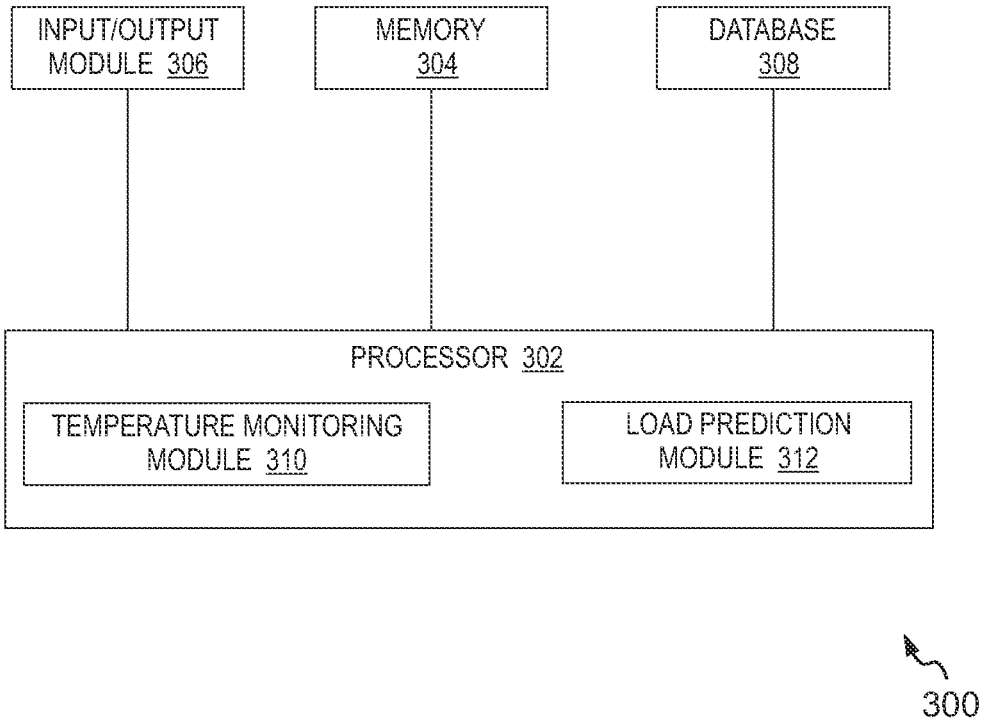
FIG. 3 is a block diagram representation of a control unit of the hydronic system of FIGS. 2A and 2B, in accordance with an example embodiment of the present disclosure.

FIG. 3 in one exemplary embodiment of the present disclosure, is a block diagram representation 300 of the control unit 214 (shown in FIG. 2) configured for operating the hydronic system 200. The control unit 214 includes various processing modules for operating the hydronic system 200. The processing modules described herein may be implemented by a combination of hardware, software and firmware components.

The system 200 includes a processor 302, a memory 304, an input/output module 306, and a database 308. The processor 302 includes a temperature monitoring module 310 and a load prediction module 312. It is noted that although the control unit 214 is depicted to include only one processor 302, the control unit 214 may include a number of processors. Moreover, it shall be noted that the components are shown for exemplary purposes and the control unit 214 may include fewer or additional modules than those depicted in FIG. 3.

In an embodiment, the memory 304 is capable of storing machine-executable instructions. Further, the processor 302 is capable of executing the machine executable instructions to perform the functions described herein. The processor 302 embodies or is in communication with the components, such as the temperature monitoring module 310 and the load prediction module 312. In an embodiment, the processor 302 may be embodied as a multi-core processor, a single core processor, or a combination of one or more multi-core processors and one or more single core processors. For example, the processor 302 may be embodied as one or more of various processing devices, such as a coprocessor, a microprocessor, a controller, a digital signal processor (DSP), a processing circuitry with or without an accompanying DSP, or various other processing devices including integrated circuits such as, for example, an application specific integrated circuit (ASIC), a field programmable gate array (FPGA), a microcontroller unit (MCU), a hardware accelerator, a special-purpose computer chip, or the like. In an embodiment, the processor 302 may be configured to execute hard coded functionality. In an embodiment, the processor 302 is embodied as an executor of software instructions, wherein the instructions may specifically configure the processor 302 to perform the algorithms and/or operations described herein when the instructions are executed.

The memory 304 may be embodied as one or more volatile memory devices, one or more non-volatile memory devices, and/or a combination of one or more volatile memory devices and non-volatile memory devices. For example, the memory 304 may be embodied as magnetic storage devices (such as hard disk drives, floppy disks, magnetic tapes, etc.), optical magnetic storage devices (e.g. magneto-optical disks), CD-ROM (compact disc read only memory), CD-R (compact disc recordable), CD-R/W (compact disc rewritable), DVD (Digital Versatile Disc), BD (Blu-ray® Disc), and semiconductor memories (such as mask ROM, PROM (programmable ROM), EPROM (erasable PROM), flash memory, RAM (random access memory), etc.).

In an embodiment, the input/output module 306 may include mechanisms configured to receive input information or inputs form the user 102 and also provide output to the user 102 via the application 116. To that effect, the input/output module 306 may include at least one interface and/or at least one output interface. The input/output module 306 may be configured to receive the input information from the user 102 for operating the hydronic system 200.

The temperature monitoring module 310 may be configured to monitor the temperatures associated with the hot water and the cold water. Particularly, the module 310 is configured to monitor the operating temperatures of the hot water and the cold water within, entering or exiting the hot storage tank 202*d* and the cold storage tank 202*e*. The module 310 may monitor the operating temperatures of the hot water and the cold water, based on the temperature measured by the temperature sensors 218 and 220 respectively. Additionally, the module 310 is communicably coupled to the first temperature sensor 226 for monitoring the temperature at which the hot water is being delivered to either of the domestic water supply tank 210 and the thermal distributor 206. This configuration enables to ascertain the temperature given thermal losses associated with the ambient temperature while the water is in the tank, and during flow of the hot water in the conduits. This allows the system 200 to compensate for the thermal losses. This configuration also provides information to calculate the SoC of the water in the tank. The module 310 also monitors the temperature at which the chilled water is being delivered to either of the domestic water supply tank 210 and the thermal distributor 206. This configuration enables to ascertain the temperature given thermal losses associated with the ambient temperature while the water is in the tank, and during the flow of water in the conduits. This configuration also provides information to calculate the SoC of the water in the tank 202*d*. This allows the system 200 to compensate for the thermal losses. In one implementation, the module 310 may determine the operating temperatures of the hot water and the cold water, based on the climatic conditions or the operation cycle of the system 200.

The load prediction module 312 may be configured to determine the load during operation of the system 200. The load may be amount or volume of hot water or the cold water being dispensed from the tanks 202*d* and 202*e*, or may be the expected demand of the user 102 or any other parameter as per feasibility. Typically, during operation of the system 200, the hot water and the cold water may be dispensed at a steady rate from the tanks 202*d* and 202*e*. As such, based on the demand, the thermal losses associated with the flow of the hot water and the cold water, the module 312 may be configured to determine the required SoC of hot water and/or the cold water to be maintained in their respective storage tanks. The module 312 may determine the load, based on the storage capacity for the hot water and the cold water in the tanks 202*d* and 202*e*. The module 312 may be thus associated with the flowmeters 222*a*, 222*b*, 222*c*, 228*a*, and 228*b*, for monitoring the flow of the hot water and the cold water respectively.

Additionally, the control unit 214 includes the database 308 configured for storing information pertaining to the input information provided by the user 102. The database 308 may also be configured to store information exchanged or generated during each step of the analysis by the processor 302, for operating the hydronic system 200. The database 308 may also be configured to store information pertaining to the costs associated with use of the power source along with its operation cycle. The database 308 may be encrypted suitably for ensuring the security of the stored information. The database 308 may also be configured to maintain log of the data processed by each of the modules (such as the temperature monitoring module 310 and the load prediction module 312) within the processor 302. The log allows the user 102 to track and understand the analysis performed by the processor 302.

The various modules of the control unit 214, such as the processor 302, the memory 304, the I/O module 306, the database 308, the temperature monitoring module 310 and the load prediction module 312 may be configured to communicate with each other through a centralized circuit system (not shown in Figures). The centralized circuit system may be various devices configured to, among other things, provide or enable communication between the components (302-312) of the control unit 214. In certain embodiments, the centralized circuit system may be software-based, a central printed circuit board (PCB) such as a motherboard, a main board, a system board, or a logic board. The centralized circuit system may also, or alternatively, include other printed circuit assemblies (PCAs) or communication channel media. In some embodiments, the centralized circuit system may include appropriate communication interfaces to facilitate communication between the processor 302 and the components 304 to 312. The database 308 may communicate with the processor 302 using suitable storage interface such as, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor 302 with access to the data stored in the database 308.

Figure 4:
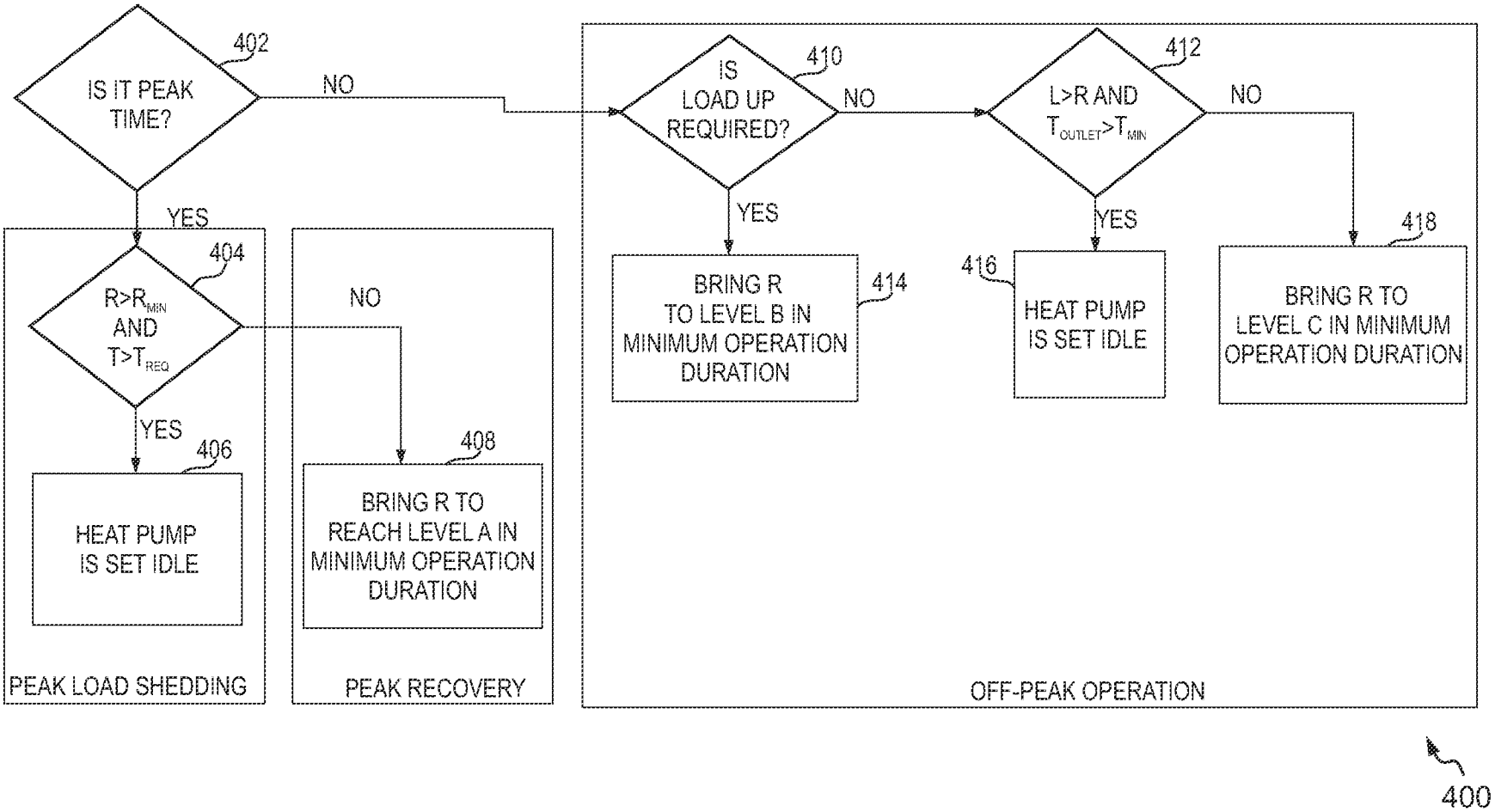
FIG. 4 is a flow diagram illustrating a method of operating the hydronic system by the control unit during an on-peak operation cycle and an off-peak operation cycle, in accordance with an example embodiment of the present disclosure.

FIG. 4 in one exemplary embodiment of the present disclosure, is a flow diagram 400 illustrating a method of operating the hydronic system 200 by the control unit 214 during an on-peak operation cycle and an off-peak operation cycle. The control unit 214 may monitor the condition of the hot water and/or the chilled water (hereinafter referred to State of Charge (SoC)) for operating the system 200. On determining the SoC, the control unit 214 determines the operation cycle, for operating the heat pump unit 208 suitably. The operation cycle includes the on-peak operation cycle and the off-peak operation cycle. In one implementation, the on-peak operation cycle may be the time period in which the demand for use of the system 200 will be the highest. As an example, the time period between 6 AM to 9 AM and 6 PM to 9 PM of a day, where the user 102 is engaged in daily activities, may be considered as the on-peak operation cycle. In another implementation, the on-peak operation cycle may be the time at which the cost of energy is highest. As an example, the time period between 5 pm and 9 pm, may be the time at which the cost of energy is highest. The off-peak operation cycle may be the remainder time period of the day. In one implementation, the on-peak operation cycle may also be based on the load acting or the demand for the hot water and/or cold water for the enclosure 212. The control unit will trigger the operation of the system 200 to bring the SoC of the tank up to a number of different levels, for example levels A, B or C, depending on the operation cycle, SoC and user load requirements or expected requirements.

At step 402, the control unit 214 determines whether the operation cycle is the on-peak operation cycle. The control unit 214 may determine the operation cycle based on the demand of the hot water and/or the chilled water, or the time of the day or any other suitable parameter as per feasibility and requirement. If the control unit 214 determines the on-peak operation cycle, the method proceeds to step 404.

At step 404, the control unit 214 monitors the SoC of the hot water and/or the chilled water. That is, the control unit 214 determines the SoC of the hot water and/or the chilled water (hereinafter referred to as water) in the tanks 202*d* and 202*e* respectively. In step 404, the control unit 214 monitors whether the current SoC (i.e. reserve, R) of the water is greater than a min reserve $R_{min}$ of the water and whether the flow temperature T of the water is greater than required temperature $T_{req}$ by the user 102 (or 'shed minimum temperature'). In one implementation, for hot water the flow temperature is required to be greater than the shed minimum temperature, while for chilled water the flow temperature is required to be lesser than the shed maximum temperature, for complying the condition in step 404. If the condition specified in step 404 is met, the control unit 214 maintains the idle condition of the heat pump unit 208 at step 406. This scenario may be considered as 'load shedding' in the system 200. If the condition specified in step 404 is not met, the control unit 214 operates the heat pump unit 208 for recharging the water to reach a SoC level A (which can be the expected hot water or chilled water needed over the remainder of the peak period plus a reserve $R_{min}$). For operating the heat pump unit 208, the control unit 214 determines the time period required for recharging the water, and accordingly operates the heat pump unit 208. This scenario may be considered as 'peak recovery', since the recovery of recharge is occurring during the on-peak operation cycle.

Further, when the control unit 214 determines that the current operation cycle is the off-peak operation cycle, the method proceeds to step 410. At step 410, the control unit 214 determines whether a load-up or recharging of the water is required. If the load-up is required, the heat pump unit 208 is operated for recharging the water at step 414. In this scenario, the SoC of the water is now raised to level B, which is greater than the level A (as per step 408). Recharging the water to level B provides a buffer for the system 200 to be idle until the volume of the water is reduced or temperature of the water is reduced. This mechanism, prevents frequent operation of the heat pump unit 208, thereby employing minimal power from the power source. Consequently, incurring a lower operational cost of the system 200. If the control unit 214 determines that the load-up is not required, the method proceeds to step 412.

At step 412, the control unit 214 determines whether the SoC of the water, L is greater than the reserve, R (or normal reserve) or whether the flow temperature, $T_{outlet}$ (or outlet temperature) of the water is greater than a minimum temperature, $T_{min}$ specified by the user 102. If the condition in step 412 is satisfied, the method proceeds to step 416, where the control unit 214 maintains idle condition of the heat pump unit 208. If the condition specified in step 412 is not met, the method proceeds to step 418.

At step 418, the control unit 214 operates the heat pump unit 208 for raising the volume or amount of the water to level C, while meeting minimum operation duration (as described for step 414).

In one implementation, the each of the levels A, B and C indicated in the FIG. 2B, may be the volume of the water required to meet a certain user requirement. For example, the level C may be the expected requirement of the hot water and/or the cold water from the tank 202 until the start of the next on-peak period plus the reserve volume R. The volume of the water may be the volume of the water and the temperature of the water required for complying the with the user requirement. Similarly, the level A may be the expected requirement of the volume of the hot water and/or the cold water from the tank 202 during the off-peak period. The level B may be the expected buffer volume of the hot water and/or cold water from the tank 202. The level D may be the maximum volume of the hot water and/or the cold water that can be contained in the tank 202 for use.

Figure 5:
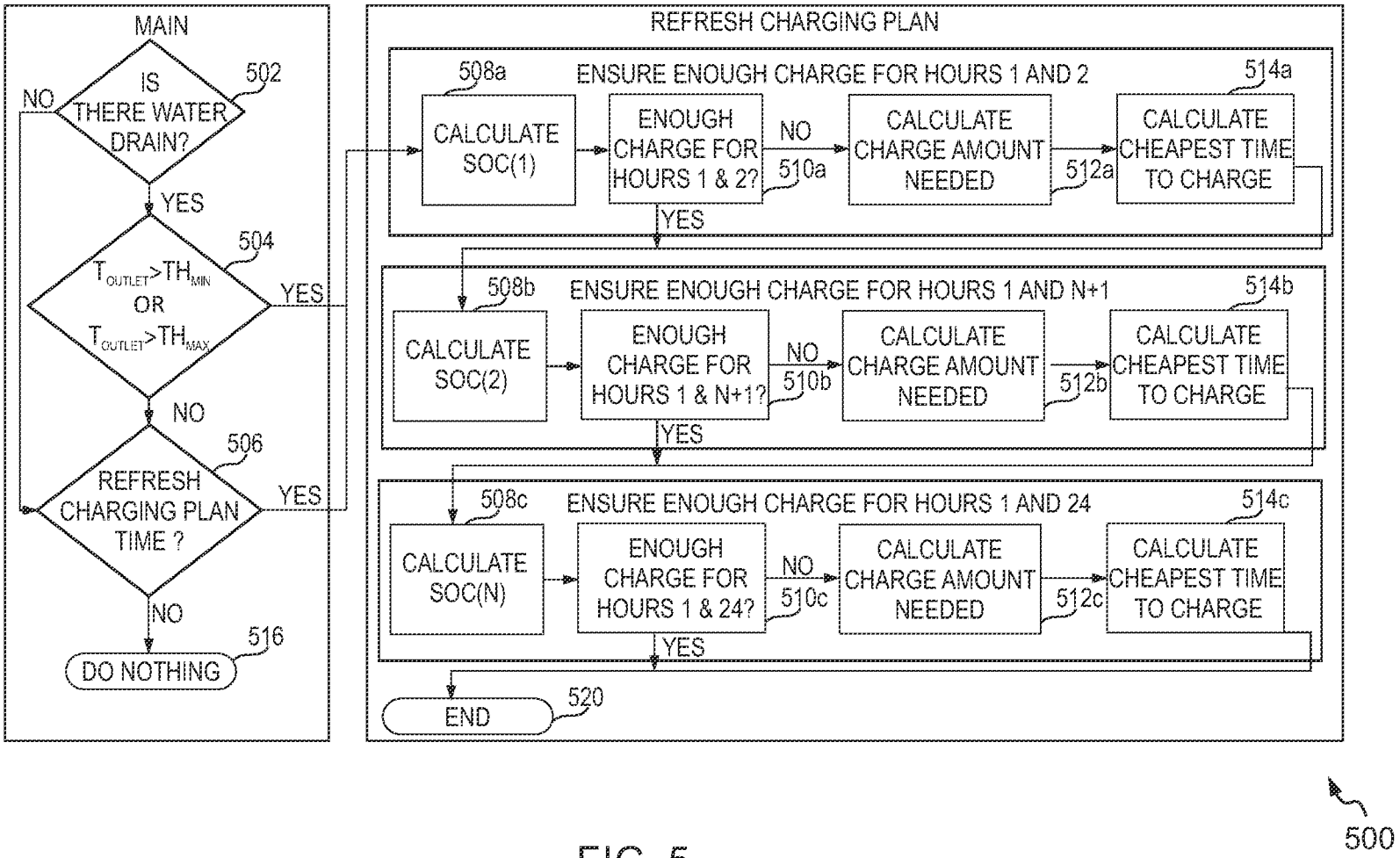
FIG. 5 is a flow diagram illustrating a method of operating the hydronic system by the control unit using dynamic hourly charging, in accordance with another example embodiment of the present disclosure.

FIG. 5 in one exemplary embodiment of the present disclosure is a flow diagram 500 illustrating a method of operating the hydronic system by the control unit 214 using dynamic hourly price optimization. The flow diagram 500 may also be considered as a method for computing the load to be circulated within the system 200.

At step 502, the control unit 502 determines whether there is a draw of water from any of the tanks 202*d* and 202*e*, via the flowmeters 222 and 228. In one implementation, the control unit 214 may determine the flow of the water from the tanks 202*d* and 202*e* via flowmeters 222 and 228 that may be configured in the conduits suitably.

At step 504, the control unit 214 determines whether the outlet temperature of the water ($T_{outlet}$) is lesser than a minimum threshold ($Th_{min}$) defined by the user 102 for the tank 202*d*. For the tank 202*e*, the control unit 214 determines whether the outlet temperature ($T_{outlet}$) is greater than the maximum threshold ($Th_{max}$) defined by the user 102. If this condition of step 504 is satisfied, the control unit moves ahead to step 508 described below. If this condition is not satisfied, the control unit 214 moves ahead to step 506, where it decides whether it is time to refresh the charging plan. The charging plan may be a model employed by the control unit 214 for determining the optimum and cost-effective means for recharging the water in the tanks 202*d* and 202*e*. If the condition in the step 506 is satisfied, the method proceeds to step 508, which is the charging plan. Otherwise, the method proceeds to step 516.

The charging plan illustrated in the FIG. 5 examines the charging need for the following 24 hours iteratively, starting with the next hour. The plan with the references 508*a*-514*a* ensures there is enough charge for hours 1 and 2, the plan with references 508*b*-514*b* is an iterative plan ensuring that there is enough charge to meet the need from hours 1 to 3, 1 to 4, 1 to n+1 and the plan with references 508*c*-514*c* is the last plan ensures there is enough charge from hours 1 to 24 hours.

At the step 508*a*, the control unit 214 computes the current SoC. The SoC may be computed based on the data collated during operation of the system 200 in the previous cycles, or via the input information provided by the user 102.

In step 510*a* the control unit compares the SoC to the load that system 200 is required to deliver for hours 1 and 2. If the SoC is sufficient to meet the expected load for hours 1 and 2 then the method proceeds to step 508*b*. If the SoC is not sufficient to meet the expected load for hours 1 and 2, then the method proceeds to step 512*a*. At step 512*a*, the control unit 214 now calculates the expected charge amount or volume needed to meet the expected load for hours 1 and 2. Upon computation of the difference, that is required to achieve the charge calculated in step 510*a*, the control unit determines the cheapest or lowest emissions or other parameter time for charging the tanks 202*d* and 202*e* at step 514*a*. That is, the control unit 214 determines the cheapest or lowest emissions time for operating the heat pump unit 208 for recharging. The cheapest time may be stored or made available in the database 308 or 112, may be in the form of a look-up table. As such, the control unit 214 may access the look up table for ascertaining the time periods at which the cost of use of power source (or electricity) is the cheapest. Accordingly, the heat pump unit 208 is operated for recharging.

As described above, steps 510*b*-514*b* and steps 510*c*-514*c* operate similar to the steps 510*a*-514*a*, with the difference being the time period considered for computations. In an example of this embodiment, the iterative steps may increase the charge requirement for the earlier time periods, but may not decrement it. The process of refresh charging plan ends at 520.

Figure 6:
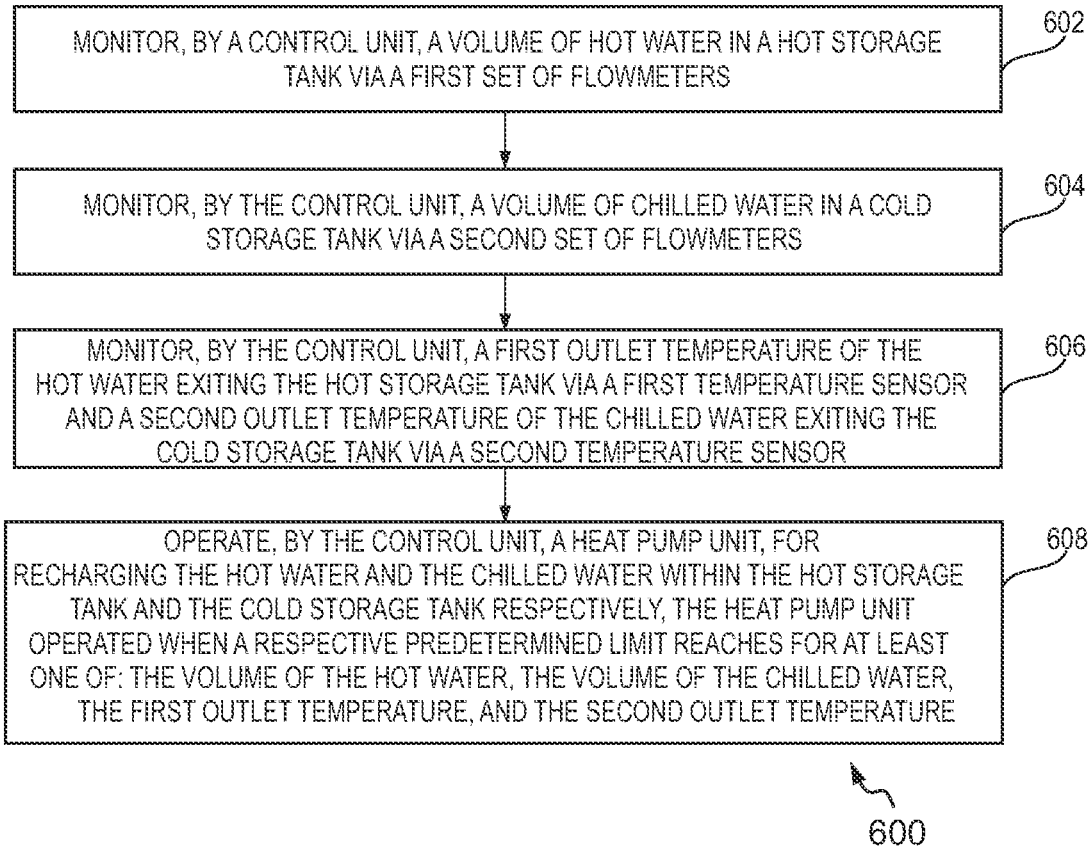
FIG. 6 is a flow diagram for a method for operating the hydronic system, in accordance with an embodiment of the present disclosure.

FIG. 6 in one exemplary embodiment of the present disclosure is a flow diagram for a method 600 for operating the hydronic system 200. The method 600 depicted in the flow diagram may be executed by, for example, the server 114 or the system 108. Operations of the method 600 and combinations of operation in the flow diagram, may be implemented by, for example, hardware, firmware, a processor, circuitry and/or a different device associated with the execution of software that includes one or more computed program instructions.

At operation 602 of method 600, the control unit 214 monitors the volume of hot water within the tank 202*d* using the flowmeters 222. Subsequently, the control unit 214 monitors the volume of chilled water within the tank 202*e* via the flowmeters 228 at operation 604.

At operation 606 of method 600, the control unit 214 determines the first outlet temperature of the hot water via the temperature sensor 218. Subsequently, the control unit 214 monitors the second outlet temperature of the chilled water via the temperature sensor 220. Thus, at operations 602-606, the control unit 214 monitors the SoC of the water, which is already described in detail in descriptions pertaining to FIGS. 4 and 5.

At operation 608 of method 600, the control unit 214 is configured to operate the heat pump unit 208 for recharging the hot water and the chilled water within the tanks 202*d* and 202*e*. The heat pump unit 208 is operated when a respective predetermined limit reaches for at least one of the volume of the water (i.e., hot water and chilled water) and their corresponding operating temperatures. The description pertaining to the operation of the heat pump unit 208 is already described in detail in descriptions pertaining to FIGS. 4 and 5, and is not reiterated in this section.

Figure 7:
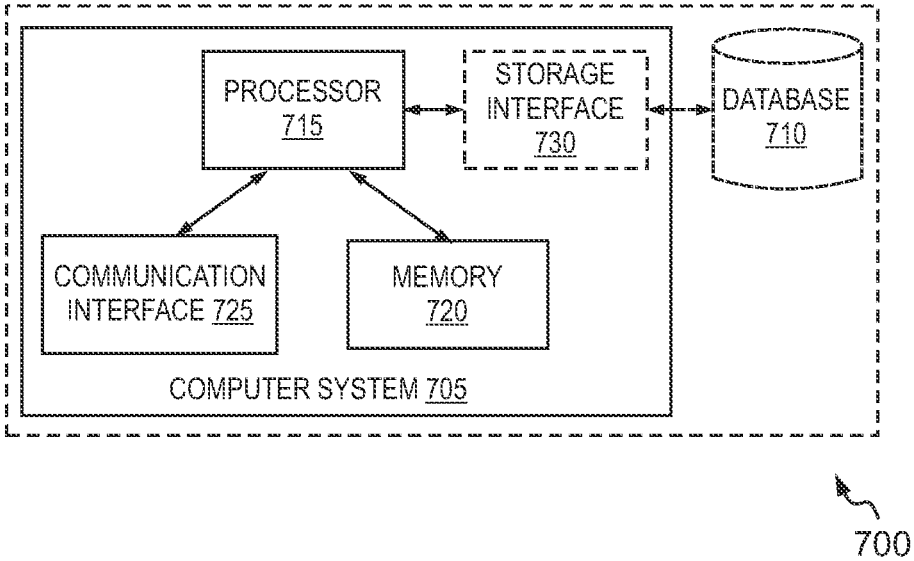
FIG. 7 is a block diagram of a server capable of implementing at least some embodiments of the present disclosure.

FIG. 7 illustrates a block diagram representation of a server 700 capable of implementing at least some embodiments of the present disclosure. The server 700 is configured to host and manage the application 116 that is provided to an electronic device such as the device 104, in accordance with an example embodiment of the disclosure. An example of the server 700 is the server 114 shown and described with reference to FIG. 1. The server 700 includes a computer system 705 and a database 710.

The computer system 705 includes at least one processor 715 for executing instructions. Instructions may be stored in, for example, but not limited to, a memory 720. The processor 715 may include one or more processing units (e.g., in a multi-core configuration).

The memory 720 is a storage device embodied as one or more volatile memory devices, one or more non-volatile memory devices, and/or a combination of one or more volatile memory devices and non-volatile memory devices, for storing micro-contents information and instructions. The memory 720 may be embodied as magnetic storage devices (such as hard disk drives, floppy disks, magnetic tapes, etc.), optical magnetic storage devices (e.g., magneto-optical disks), CD-ROM (compact disc read only memory), CD-R (compact disc recordable), CD-R/W (compact disc rewritable), DVD (Digital Versatile Disc), BD (Blu-ray® Disc), and semiconductor memories (such as mask ROM, PROM (programmable ROM), EPROM (erasable PROM), flash ROM, RAM (random access memory), etc.).

The processor 715 is operatively coupled to a communication interface 725 such that the computer system 705 is capable of communicating with a mobile device, for example, the device 104 or communicates with any entity within the network 106 via the communication interface 725.

The processor 715 may also be operatively coupled to the database 710. The database 710 is any computer-operated hardware suitable for storing and/or retrieving data, such as, but not limited to, the input information, the temperature data, the load data, data obtained during operation of the system 200 and the like. The database 710 may include multiple storage units such as hard disks and/or solid-state disks in a redundant array of inexpensive disks (RAID) configuration. The database 710 may include a storage area network (SAN) and/or a network attached storage (NAS) system.

In some embodiments, the database 710 is integrated within the computer system 705. For example, the computer system 705 may include one or more hard disk drives as the database 710. In other embodiments, the database 710 is external to the computer system 705 and may be accessed by the computer system 705 using a storage interface 730. The storage interface 730 is any component capable of providing the processor 715 with access to the database 710. The storage interface 730 may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing the processor 715 with access to the database 710.

The processor 715 is communicably coupled with the memory 720 and the communication interface 725. The processor 715 is capable of executing the stored machine executable instructions in the memory 720 or within the processor 715 or any storage location accessible to the processor 715. The processor 715 may be embodied in a number of different ways. In an example embodiment, the processor 715 may be embodied as one or more of various processing devices, such as a coprocessor, a microprocessor, a controller, a digital signal processor (DSP), processing circuitry with or without an accompanying DSP, or various other processing devices including integrated circuits such as, for example, an application specific integrated circuit (ASIC), a field programmable gate array (FPGA), a microcontroller unit (MCU), a hardware accelerator, a special-purpose computer chip, or the like. The processor 715 performs various functionalities of the server 700 as described herein.

The disclosed methods with reference to FIG. 1 to 7, or one or more operations of the flow diagrams 400 and 500 may be implemented using software including computer-executable instructions stored on one or more computer-readable media (e.g., non-transitory computer-readable media, such as one or more optical media discs, volatile memory components (e.g., DRAM or SRAM), or nonvolatile memory or storage components (e.g., hard drives or solid-state nonvolatile memory components, such as Flash memory components) and executed on a computer (e.g., any suitable computer, such as a laptop computer, net book, Web book, tablet computing device, smart phone, or other mobile computing device). Such software may be executed, for example, on a single local computer or in a network environment (e.g., via the Internet, a wide-area network, a local-area network, a remote web-based server, a client-server network (such as a cloud computing network), or other such network) using one or more network computers. Additionally, any of the intermediate or final data created and used during implementation of the disclosed methods or systems may also be stored on one or more computer-readable media (e.g., non-transitory computer-readable media) and are considered to be within the scope of the disclosed technology. Furthermore, any of the software-based embodiments may be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), mobile communications, or other such communication means.

Various embodiments of the disclosure, as discussed above, may be practiced with steps and/or operations in a different order, and/or with hardware elements in configurations, which are different than those which are disclosed. Therefore, although the disclosure has been described based upon these exemplary embodiments, it is noted that certain modifications, variations, and alternative constructions may be apparent and well within the spirit and scope of the disclosure.

Although various exemplary embodiments of the disclosure are described herein in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A hydronic system, comprising:

a control unit, comprising:

a memory comprising stored instructions; and a processor configured to execute the stored instructions to cause the control unit to perform at least:

monitoring, a volume of hot water in a hot storage tank via a first set of flowmeters;

monitoring, a volume of chilled water in a cold storage tank via a second set of flowmeters;

monitoring, a first outlet temperature of the hot water within the hot storage tank via a first temperature sensor and a second outlet temperature of the chilled water within the cold storage tank via a second temperature sensor; and operating, a heat pump unit for recharging the hot water and the chilled water within the hot storage tank and the cold storage tank respectively, the heat pump unit operated when a respective predetermined limit reaches for at least one of:

the volume of the hot water, the volume of the chilled water, the first outlet temperature, and the second outlet temperature, wherein for operating the heat pump unit for recharging the hot water and the chilled water, the control unit is caused to perform at least one of:

selectively operating the heat pump unit based on a cost, emissions and a schedule of operation of a power source for recharging the hot water, when at least one of the volume of hot water and the first outlet temperature have reached a respective predetermined limit, and selectively operating the heat pump unit based on a cost, emissions and a schedule of operation of a power source for recharging the chilled water, when at least one of the volume of chilled water and the second outlet temperature have reached a respective predetermined limit.

2. The hydronic system as claimed in claim 1, wherein the hot water and the chilled water are selectively routed to an enclosure via a pump fluidically coupled to the hot storage tank, the cold storage tank and the enclosure.

3. The hydronic system as claimed in claim 2, wherein the control unit is configured to determine a temperature of the hot water routed into a thermal distributor via a first temperature sensor configured in a conduit connecting the hot storage tank and the thermal distributor.

4. The hydronic system as claimed in claim 3, wherein the control unit is configured to operate the heat pump for recharging the hot water within the hot storage tank, when the temperature reaches a threshold limit.

5. The hydronic system as claimed in claim 1, wherein the control unit is configured to determine a temperature of the chilled water routed from an enclosure via a second temperature sensor configured in a conduit connecting the cold storage tank and the enclosure.

6. The hydronic system as claimed in claim 1, wherein the control unit is configured to operate the heat pump unit for recharging the chilled water within the cold storage tank, when the temperature reaches a threshold limit.

7. The hydronic system as claimed in claim 1, wherein the hot storage tank includes the hot water settled on a top portion of the hot storage tank and a cold water settled on a bottom portion, the cold water routed to the heat pump unit for generating the hot water, the hot water generated in the heat pump unit is routed to the top portion for recharging the hot water within the hot storage tank.

8. The hydronic system as claimed in claim 1, wherein the cold storage tank includes a lukewarm water settled on a top portion of the cold storage tank and the chilled water settled on a bottom portion of the cold storage tank, the lukewarm water is routed to the heat pump unit for generating the chilled water, the chilled water generated in the heat pump unit is routed to the bottom portion for recharging the chilled water within the cold water tank.

9. The hydronic system as claimed in claim 1, wherein the control unit is configured to determine a time period required for recharging the volume of hot water, the time period determined based on the volume of the hot water, the first outlet temperature and an operation cycle, the operation cycle being at least an on-peak operation cycle and an off-peak operation cycle, wherein the control unit is configured to:

operate the heat pump unit instantaneously for recharging the hot water within the time period, when at least one of, the volume of hot water and the first outlet temperature have reached the predetermined limit and the operation cycle is in the on-peak operation cycle; and wherein the control unit is configured to selectively operate the heat pump unit for recharging the hot water when the operation cycle is in the off-peak operation cycle, wherein the cost and the schedule of operation of the power source for recharging the hot water are defined in a look-up table configured in a database communicably coupled to the control unit.

10. The hydronic system as claimed in claim 1, wherein the control unit is configured to determine a time period required for recharging the volume of chilled water, the time period determined based on the volume of the chilled water, the second outlet temperature and an operation cycle, the operation cycle being at least an on-peak operation cycle and an off-peak operation cycle, wherein the control unit is configured to:

operate the heat pump instantaneously for recharging the chilled water within the time period, when at least one of the volume of chilled water and the second outlet temperature have reached the predetermined limit and the operation cycle is in the on-peak operation cycle; and wherein the control unit is configured to selectively operate the heat pump unit for recharging the chilled water when the operation cycle is in the off-peak operation cycle, wherein the cost and the schedule of operation of the power source for recharging the chilled water are defined in a look-up table configured in a database communicably coupled to the control unit.

* * * * *